United States Patent [19]

Hanson et al.

[11] 4,047,393

[45] Sept. 13, 1977

[54] REFRIGERATOR FORCED AIR CONDENSER FILTER

[75] Inventors: Robert S. Hanson, Kettering; Ralph R. Rigg, Dayton, both of Ohio

[73] Assignee: General Motors Corporation, Detroit, Mich.

[21] Appl. No.: 730,977

[22] Filed: Oct. 8, 1976

[51] Int. Cl.[2] ..... F25D 17/06; F25B 39/04

[52] U.S. Cl. ..... 62/428; 62/506

[58] Field of Search ..... 62/428, 506, 507; 312/236

[56] References Cited

U.S. PATENT DOCUMENTS

| | | | |
|---|---|---|---|
| 2,580,535 | 1/1952 | Feinberg | 62/428 |
| 2,952,997 | 9/1960 | Mullin | 62/506 |
| 3,035,421 | 5/1962 | Halbeisen | 62/428 |
| 3,208,236 | 9/1965 | Frigerio | 62/428 |
| 3,807,146 | 4/1974 | Witkowski | 55/357 |
| 3,912,349 | 10/1975 | Hoetker | 312/236 |

*Primary Examiner*—Lloyd L. King

*Attorney, Agent, or Firm*—Edward P. Barthel

[57] ABSTRACT

A refrigerator machinery compartment air filter for a forced air condenser operative to maintain the proper air flow over the heat transfer surfaces insuring efficient operation. The filter has two sections connected by a flexible hinge allowing for ready insertion and removal from the front of the compartment for ease of cleaning.

3 Claims, 7 Drawing Figures

REFRIGERATOR FORCED AIR CONDENSER FILTER

This invention relates to refrigerating apparatus and more particularly to a removable filter arrangement for a domestic refrigerator forced air condenser.

In household refrigerating apparatus utilizing a forced air condenser it is highly desirable to provide some form of filtering means to clean this air of entrained dust or lint before it is moved over the condenser unit coils. This is particularly true when the forced air condenser is of the "rolled stack" type wherein its loop segments define a plurality of air flow spaces that obviate the free passage of lint therethrough because of the impediment to air flow. It will be appreciated, however, that after the filtering means has been in operation for an extended period the filtering means must be removed from the refrigerator machinery compartment by the operator and cleaned of entrained dust and lint by suitable means such as by a vacuum or washing.

Accordingly, it is an object of the invention to provide and improved, inexpensive, easily installed and readily removed filter for a forced air refrigerator condenser which is simple inconstruction, inexpensive and efficient in operation and which may be used over long periods of unit operation before requiring cleaning.

A further object of the present invention is to provide an improved removable two-sectioned filter, connected by a flexible hinge, for filtering room air entering both the front and bottom openings of a machinery compartment of a domestic refrigerator prior to the air being circulated through restricted air flow spaces defined by the coiled plates of a forced air condenser.

Further objects and advantages of the present invention will become apparent from the following description, reference being had to the accompanying drawings wherein.

Figure 1:
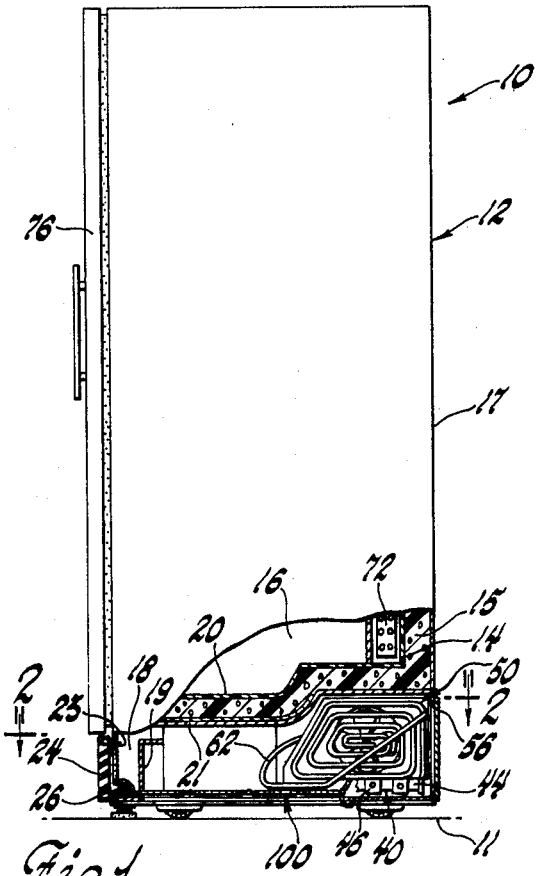
FIG. 1 is a side elevational view of a domestic refrigerator having the base thereof partially sectioned to show the machinery compartment filter of the present invention.

Referring now to the drawings, in FIG. 1 a domestic refrigerator 10 is illustrated having an outer inverted U-shaped sheet metal shell 12 surrounding an inner plastic liner 14 in spaced relationship thereto. The outer shell 12 and the inner liner 14 define a spaced which is filled with suitable thermal insulating material 15 such as foamed-in-situe foam polyurethane material. The outer metal walls of the shell 12 depend below the insulated chamber 16 to provide opposite side walls, one of which is shown at 17, which with corner frame members 19 partially define a machine compartment 18 beneath the chamber 16.

In the illustrated arrangement, the chamber 16 is defined at its lower end by a stepped bottom wall portion 20 including an outer sheet metal panel 21 which defines the upper extent of the machinery compartment 18. The top wall panel 21 of the machinery compartment terminates in a downwardly directed front flange 22, the transverse edge 23 of which defines the upper edge of the machinery compartment front access opening. A louvered closure panel 24 is removably positioned over the access opening by suitable means such as resilient clip members 25 formed to engage the underside of a structural tie member, generally indicated at 26, extending between the refrigerator side walls. In the disclosed form the structural member 26 is a U-shaped metal tube having inturned ends 27 which are flattened and suitably secured as by bolts (not shown) to the return flange portion 28 of the side walls. See U.S. Pat. No. 3,006,159 to Brown et al. for details of one such structural tie member.

Figure 2:
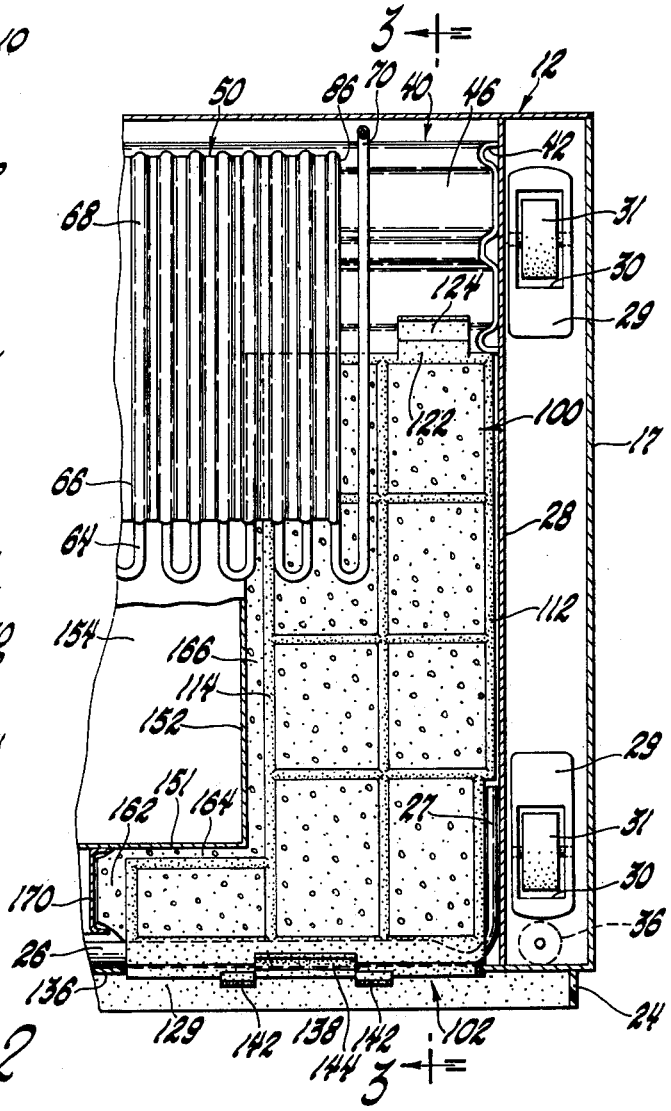
FIG. 2 is an enlarged fragmentary top view of the refrigerator machinery compartment taken on line 2—2 of FIG. 1.
Figure 3:
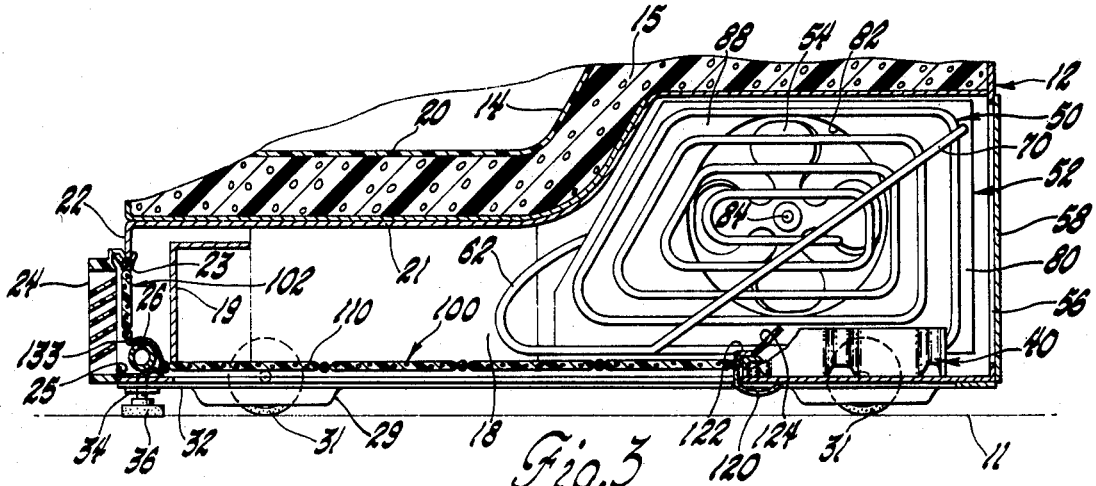
FIG. 3 is an enlarged sectional view of the machinery compartment of FIG. 1 taken on line 3—3 of FIG. 2.

As seen in FIGS. 2 and 3, rigidly affixed by conventional means, such as spot welding or the like, to the cabinet shell side walls are reinforcing gussets 29 each containing a rectangular opening 30 having a height adjustable nylon roller 31 positioned therein as shown and described in U.S. Pat. No. 3,534,420 to Kesling, et al., assigned to the same assignee as the present application. The gussets 29 have front horizontal flanges 32 which extend forwardly thereof. The flange contains a small rectangular block 34 secured thereto having a vertically directed threaded bore which threadably receives a corner foot 36 or leg that supports the weight of the refrigerator, when the wheel is retracted as discussed in detail in the mentioned Kesling et al. patent.

A stamped sheet metal support pad 40 is directed through the machinery compartment 18 from inner side flange 28 at one side of the shell to the opposite inner side flange (not shown) at the opposite side of the outer shell 12. It includes upwardly turned ends as seen by end 42 in FIG. 2, suitably secured to side flanges 28 as by screws (not shown). See U.S. Pat. No. 3,524,329 to Smith et al., assigned to the assignee of the instant application, for details for details of a typical assembly. Spaced-apart integral channels 46 reinforce the length of the pad 40.

As shown in the Smith et al. patent, the single pad 40 supports a refrigeration system for the refrigerator including a hermetically sealed motor compressor unit (not shown) on one end thereof and a sheet and tube refrigerant condenser 50 of the rolled type on the opposite end thereof. Intermediate the compressor unit and condenser 50 is located an air cooling fan unit, generally indicated at 52 in FIG. 3, having a motor driven fan impeller 54 positioned to draw air into the machinery compartment 18 through the grille 22 for the purpose of cooling the condenser unit. The hermetically sealed, motor compressor unit, condenser 50 and fan assembly 52 are supported by the pad 40 to be handled as a unit that can be readily inserted through a rear machinery compartment access opening 56 in the rear wall of the outer cabinet shell to the machinery compartment 24. The rear access opening 56 is closed by a baffle plate 58 that is readily removed when it is desired to service one or more of the components on the pad.

In the illustrated arrangement, the basic refrigeration system includes a discharge line 62 from the compressor unit that connects to one end of a continuously formed condenser tube 64 (FIG. 2) that is wound sinosoidally along the length of a heat transfer sheet 66 of the condenser 50.

The tube 64 includes a plurality of parallel passes seated in longitudinal grooves 68 in the sheet member 66. The member 62 is fixedly secured to the passes of tube 64 by suitable means such as weld spots. An outlet 70 from the condenser 50 is directed through the machinery compartment and upwardly through the base 20 of the refrigerator cabinet to be connected to a suitable refrigerant expansion means (not shown) such as an elongaged capillary tube to the inlet of a refrigerant evaporator unit 72 connected by a suction line (not shown) to the inlet of the compressor. Expansion of the refrigerant removes heat from the food storage compartment or chamber 16, which, in the present embodiment is divided into side-by-side compartments closed by doors 76.

The fan assembly 52, interposed between the motor compressor unit and the closely adjacent located condenser 50, more particularly, includes a sheet metal housing 80 having its base fixedly connected to the pad 40 and a fan opening 82 coaxially aligned with the condenser 50. A fan motor (not shown) is secured on one side of the housing 80 and includes a shaft 84 which has the fan impeller 54 secured thereto and rotated within the fan opening 82. During refrigeration operation, to improve heat removal from a condenser 50, the fan impeller 56 is rotated at a substantially high r.p.m. in the order of 1250 to draw air into the inlet end 86 of the condenser 50 as viewed in FIG. 2. As explained in the above-mentioned Smith patent, the sheet number 66 is formed in a plurality of narrow air flow passageways 88 extending from the inlet end 86 of the condenser to the outlet end adjacent the fan assembly. Each of the passageways 88 is in communication with one another to form a spiral-like path through the full extent of the windings of the sheet member 66 from the inner end to the outer end such that all of the openings 88 define a cross-sectional, flow area in coaxial alignment with the fan opening 82 whereby during rotation of the impeller or fan 54, air will be drawn through the openings 88 without obstruction and across the conduit 64 wound on the sheet element in good connection heat transfer relationship therewith.

The air within the enclosure or kitchen where the refrigerator is located generally acquires a considerable amount of entrained dust, dirt or lint in every day living, and by virtue of this air being drawn into the machinery compartment 18 by the fan 52 for movement over the condenser 50 it has been realized that some provision should be made for continuously cleaning the air. The present invention provides a filtering arrangement for use with refrigerator 10 which consists of a removable air filtering means, generally indicated at 100, adapted for coextensively covering both the front and bottom openings in the machinery compartment in communication with the inlet portion 86 of the condenser.

As best seen in FIGS. 2–6, the air filtering means 100 is in the form of front 102 and bottom 104 filter batt members each of which includes a supporting outer or border frame extending around filter batts which in the disclosed form are rectangular grids integrally molded to foam plastic material 110. Reference may be had to U.S. Pat. No. 3,807,147 to Henry J. Witkowski, entitled "Mold for Making a Filter" for the particular details of one method of making a grip supported foam plastic filter.

Figure 6:
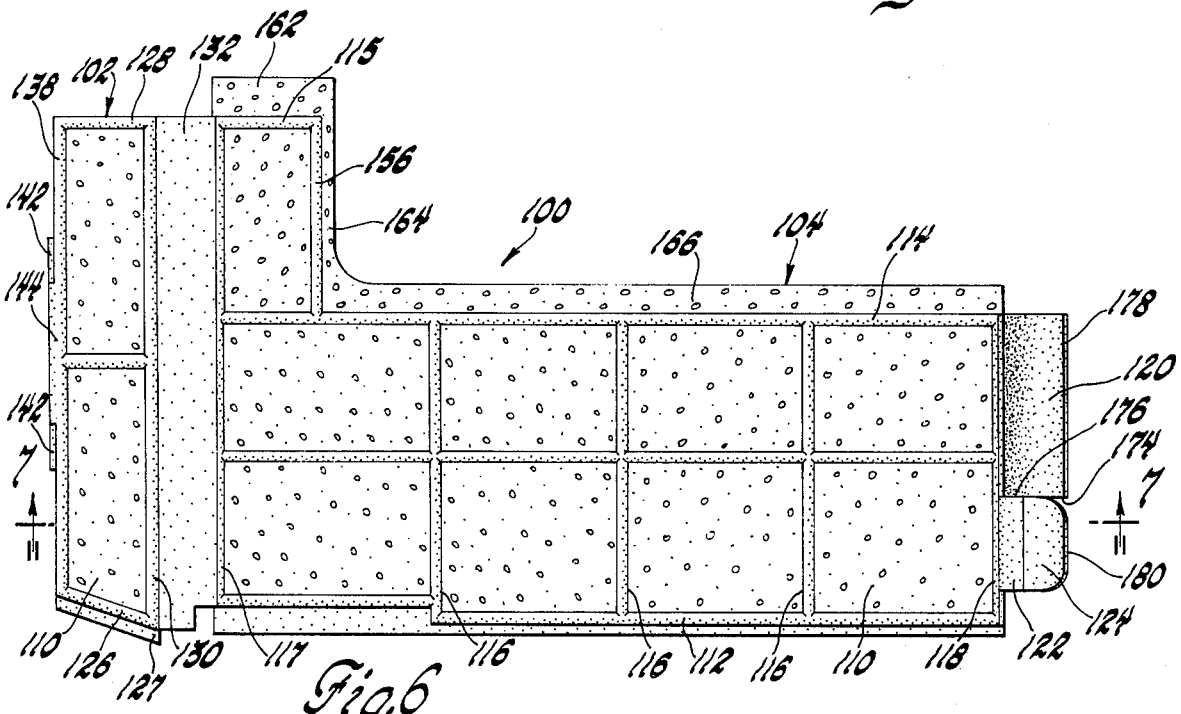
FIG. 6 is an enlarged detail plan view of the removable filter of the present invention.

As seen in FIG. 6, the border frame for the bottom filter member 104 includes longitudinal frame members 112 and 114 interconnected by transverse intermediate frame members 116 and end frame members 117 and 118. The rearward end frame member 118 includes attaching means operative to engage the forward portion of plate or pad member 30. The attaching means includes a lower concavo-convex downwardly bowed runner 120 which is integrally supported on and extends rearwardly from a rib member 121 supported on the frame member 118. The runner 120 is located adjacent the intermediate longitudinal frame member 114 substantially intermediate or symmetrical with the air filter structure 100 longitudinal frame left and right borders 115 and 112 respectively. The central location of runner 120 allows the filter assembly 100 to be adapted to contact and readily slide along the supporting surface or floor 11 for easy insertion of the filter member 104 through the machinery compartment 18 front acess opening and along the surface 11 for passage below the refrigeration components in compartment 18.

Figure 4:
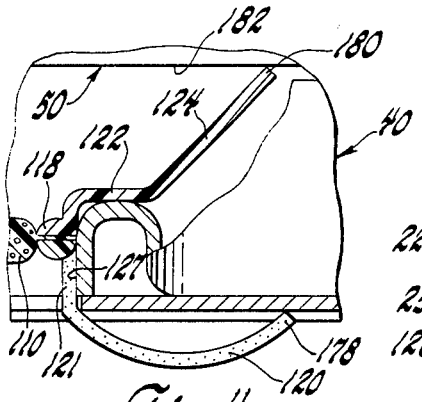
FIG. 4 is an enlarged fragmentary view of a portion of FIG. 3.

As seen in FIG. 4 and 6, the filter assembly attaching means further includes an upper flange 122 integrally formed along the top edge of rib 121 adjacent the right hand side frame 112. It will be noted that the flange 122 includes an upwardly and rearwardly diverging flexible lead-in cam member or blade 124 adapted to contact the underside of the condenser 50, as seen in FIG. 4, whereby the attaching means is guided by the runner 120 and the cam member 124 into aligned engagement with the forward face portion 127 of pad 40 to locate the bottom filter member 104 so that it closes the machinery compartment bottom opening extending between support tube 26 and the pad face 127. Thus, it will be seen in FIG. 6 that the upper flange member 122 and the bowed runner 120 are vertically spaced a predetermined distance to form an offset channel, the open end of which faces rearwardly to provide attaching means operative to frictionally engage the pad front face 127 within the channel.

Figure 7:
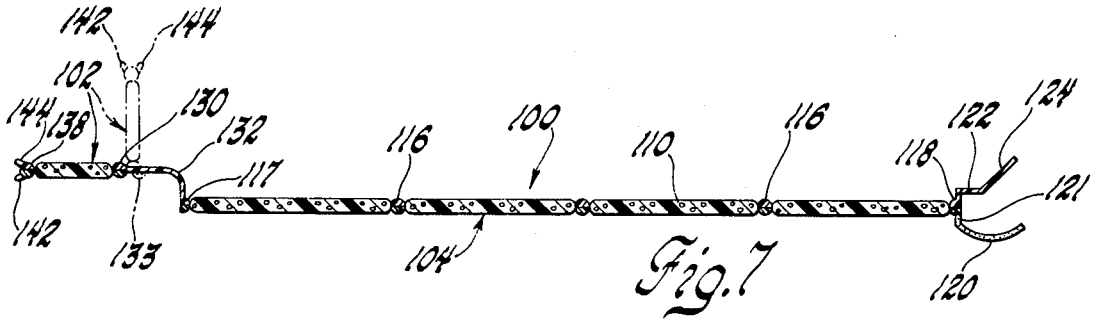
FIG. 7 is a vertical sectional view taken on line 7—7 of FIG. 6.

As best seen in FIGS. 6 and 7, the front support frame 117 of the bottom filter member 104 is integrally connected to the transverse frame member 130 of the front filter member 102 by flexible hinge means in the form of an arcuate hinge panel 132 coextensive with the filter assembly. It will be noted that the panel 132 is formed with a substantially right-angle or 90° arcuate bend whereby the front filter member 102 is positioned or biased to normally extend forwardly from the hinge panel 132 in a plane substantially parallel to and offset upwardly from the plane of the bottom filter member. Thus, as seen in FIG. 7, the front filter 102 being rotated through an angle of approximately 90° from its biased solid line position to its vertical dashed line position, the hinge panel 132 is in a stressed position imparting a reverse curve flexed portion 133.

Figure 5:
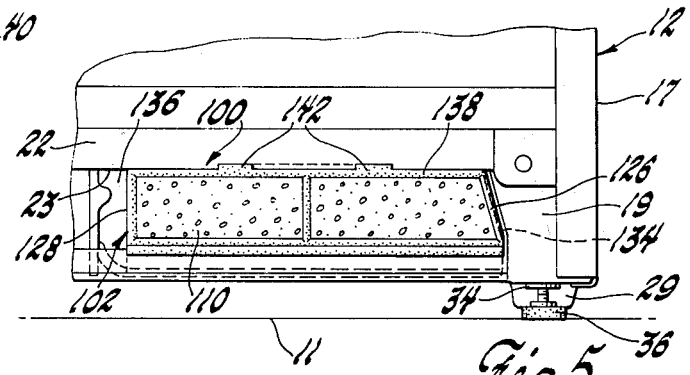
FIG. 5 is a fragmentary front elevational view of the refrigerator machinery compartment with the grille removed.

FIGS. 2 and 5 show that the front opening of the machinery compartment is defined in part by the sloping side edge 134 of right front corner frame member 19, indicated by a hidden line in FIG. 5. The corresponding right side frame member 126 of front member 102 is angularly disposed to conform with edge 134 while the frame member 126 is formed with a sealing flap 127 which overlies the front face of corner member 19. The front filter opposite or left side frame member 128 is positioned to overlie the side edge 129 of intermediate machinery compartment wall member 136.

As seen in FIG. 3, with the bottom filter member 104 is place closing the machinery compartment bottom opening, the stressed position of the hinge panel 132 conforms with the upper curvature of the tubular frame member 26. The free end of the front filter has a transverse frame member 138 which includes integral latch means selectively engageable with the edge 23 of flange 22, defining the upper portion of the machinery compartment front opening, upon the front filter 102 being rotated into its stressed vertically extending position. In this way the front filter 102 is biased in accordance with the flexibility of the hinge panel reverse curve portion 133 to effect the engagement of its integral latch means with the upper edge 23. As seen in FIGS. 6 and 7, the latch means includes integral forwardly angled front tabs 142 located in a spaced-apart manner at either end of a central rearwardly angled central tab 144 such that the latching means releasably engages the edge 23 by virtue of the central tab 144 being snapped or flexed downwardly past edge 23 into position rearwardly of the flange 22 while the paired front tabs 142 engage the front face of the flange 22.

As best seen in FIG. 2, the bottom opening of the machinery compartment is defined in part by the walls 151 and 152 of a divider member 154. To insure the sealing of this portion of the machinery compartment bottom opening the filter member 104 has a "cut-out" portion defined by frame side member 114 and cross frame member 156 with left side frame member 115 aligned with side frame member 128 of the front filter 102. The bottom filter 104 is provided with free flap portion 162, 164 and 166 forming integral extensions of the frame members 158, 156 and 114 respectively. The flap portions are preferably formed of the same foam plastic material as the filter portions 110 to provide resilient edge seals allowing effective sealing contact of the walls 151 and 152 together with the angle support member 170 (FIG. 2) of the cabinet. In this way applicant's two-sectioned filter structure 100 is self-sealing to any out-of-alignment conditions.

It will be noted that the right-hand edge 174 of runner 120 is coplanar with the left-hand edge 176 of the flange 122 whereby the members 120 and 122 form an offset channel for engaging the pad front edge 127. This design, which facilitates the integral molding operation of the filter structure 100 also assures the ready removal of the filter as only the runner peripheral edge 178 contacts the underside of pad 40 while the reduced upper edge 180 of cam member 124 frictionally contacts the lower surface 182 of the condenser 50.

Thus, by means of the above-described arrangement, whenever it is necessary to clean or change the filter 100 the grille is merely pulled out from its normal vertical position. The front filter panel 102 is then grasped, depressed downwardly to clear central tab 144 from edge 23 whereby the panel 102 assumes its horizontally disposed biased position allowing the bottom filter panel 104 to be pulled outwardly for removal from the compartment 18. The grille may be readily removed by depressing it beyond the shoulders and lifting the tongues out away from the edge of the top of the machinery compartment. Thus, applicants provide a novel, unitary two-section filter structure 100 arrangement for inserting, supporting and removing the air filter 100, to permit the slidable withdrawal of the filter from the machinery compartment.

While the embodiment of the present invention as herein disclosed constitutes a preferred form, it is to be understood that other forms might be adopted.

We claim:

1. A household refrigerator adapted to be supported on a floor comprising an outer cabinet having a front wall and a machinery compartment in the lower portion thereof, said front wall including a front opening communicating with said machinery compartment and being defined in part by a cabinet frame member along its lower portion and a free edge of said front wall along its upper portion, said machinery compartment including a refrigeration condenser including plate means at the rearward portion of said machinery compartment and adapted for air-cooling thereof, said machinery compartment having a bottom opening adapted to be in spaced relation to said floor and defined in part at its rearward end by said plate means and at its forward end by said lower frame member, forced air circulating means for circulating a stream of air through said openings into said machinery compartment and into air-cooling relation with said condenser, removable air filtering means adapted for coextensively covering both the front and bottom openings in said machinery compartment, said removable air filtering means including a front filter batt member for closing said front opening and a bottom filter batt member for closing said bottom opening, said front and bottom filter batt members each having a support border frame extending around the peripheral edges thereof, the border frame for said bottom batt member having a rearward transverse frame portion including attaching means operative to engage said rear plate means, said attaching means configured to form a lower downwardly bowed runner adapted to contact and slide along the floor and an upper flange, said upper flange having an upwardly and rearwardly diverging flexible lead-in cam member adapted to contact the condenser, whereby said attaching means is guided by said runner and said cam member into engaging alignment with said rear plate means upon the rearward sliding movement of the bottom filter batt member of said air filtering means to close said bottom opening, the support border frame of said front and bottom filter batt members being flexibly interconnected along their adjoining transverse frame edges by a flexible hinge panel which conforms with said cabinet frame member when said bottom opening is closed by said bottom filter batt member, said front filter batt member having a normal position extending forwardly from said hinge panel in a plane offset upwardly from the plane of said bottom filter batt member and a stressed position extending upwardly from said hinge panel, the border frame for said front filter batt member having latch means selectively engageable with the free edge of said front opening when said front filter batt is in said stressed position, said front filter batt member being movable in accordance with the flexibility of said hinge panel to effect the engagement of said latch means with said free edge, whereby said front filter batt member is maintained by its stressed position in closed and covering relation with said front access opening when said air filtering means is in said machinery compartment, and whereby downwardly pressure on said front filter batt member effects a slight flexing of said hinge panel to release said latch means from said free edge so said front filter batt member may return to its normal position for removal of said air filtering means from said machinery compartment.

2. A household refrigerator adapted to be supported on a floor comprising an outer cabinet having a front wall and a machinery compartment in the lower portion thereof, said front wall including a front opening communicating with said machinery compartment and being defined in part by a tubular cabinet frame member along its lower portion and a free edge of said front wall along its upper portion, said machinery compartment including a refrigeration condenser supported on plate means at the rearward portion of said machinery compartment and adapted for air-cooling thereof, said machinery compartment having a bottom opening adapted to be in spaced relation to said floor and defined in part at its rearward end by said plate means and at its forward end by said lower tubular member, forced air circulating means for circulating a stream of air through said openings into said machinery compartment and into air-cooling relation with said condenser, removable air filtering means adapted for coextensively covering both the front and bottom openings in said machinery compartment, said removable air filtering means including a front filter batt member for closing said front opening and a bottom filter batt member for closing said bottom opening, said front and bottom filter batt members each having a support border frame extending around the peripheral edges thereof, the border frame for said bottom batt member having a rearward transverse frame portion including attaching means operative to engage said rear plate means, said attaching means configured to form a lower downwardly bowed runner adapted to contact and slide along the floor and a transversely offset upper flange defining with said runner a rearwardly facing offset channel, said upper flange having an upwardly and rearwardly diverging flexible lead-in cam member adapted to contact the condenser, whereby said offset channel is guided by said runner and said cam member into engaging alignment with said rear plate means upon the rearward sliding movement of the bottom filter batt member of said air filtering means to close said bottom opening, the support border frame of said front and bottom filter batt members being flexibly interconnected along their adjoining transverse frame edges by a flexible hinge panel which conforms with said tubular cabinet frame member when said bottom opening is closed by said bottom filter batt member, said front filter batt member having a normal position extending forwardly from said hinge panel in a plane offset upwardly from the plane of said bottom filter batt member and a stressed position extending upwardly from said hinge panel, the border frame for said front filter batt member having latch means selectively engageable with the free edge of said front opening when said front filter batt is in said stressed position, said front filter batt member being movable in accordance with the flexibility of said hinge panel to effect the engagement of said latch means with said free edge, whereby said front filter batt member is maintained by its stressed positioned in closed and covering relation with said front access opening when said air filtering means is in said machinery compartment, and whereby downwardly pressure on said front filter batt member effects a slightly flexing of said hinge panel to release said latch means from said free edge so said front batt member may return to its normal position for removal of said air filtering means from said machinery compartment.

3. A household refrigerator adapted to be supported on a floor comprising an outer cabinet having a front wall and a machinery compartment in the lower portion thereof, said front wall including a front opening communicating with said machinery compartment and being defined in part by a tubular cabinet frame member along its lower portion and a free edge of said front wall along its upper portion, said machinery compartment including a refrigeration condenser supported on plate means at the rearward portion of said machinery compartment and adapted for air-cooling thereof, said condenser formed in loop segments forming a plurality of narrow air flow passageways, said machinery compartment having a bottom opening adapted to be in spaced relation to said floor and defined in part at its rearward end by said plate means and at its forward end by said lower tubular member, forced air circulating means for circulating a stream of air through said openings into said machinery compartment and into air-cooling relation with said condenser passageways, removable air filtering means adapted for coextensively covering both the front and bottom openings in said machinery compartment, said removable air filtering means including a front filter batt member for closing said front opening and a bottom filter batt member for closing said bottom opening, said front and bottom filter batt members each having a support border frame extending around the peripheral edges thereof, the border frame for said bottom batt member having a rearward transverse frame portion including attaching means operative to engage said rear plate means, said attaching means configured to form a lower downwardly bowed runner adapted to contact and slide along the floor and a transversely offset upper flange defining with said runner a rearwardly facing offset channel, said upper flange having an upwardly and rearwardly diverging flexible lead-in cam member adapted to contact the condenser, whereby said offset channel is guided by said runner and said cam member into engaging alignment with said rear plate means upon the rearward sliding movement of the bottom filter batt member of said air filtering means to close said bottom opening, the support border frame of said front and bottom filter batt members being flexibly interconnected along their adjoining transverse frame edges by a flexible hinge panel which conforms with said tubualr cabinet frame member when said opening is closed by said bottom filter batt member, said front filter batt member having a normal position extending forwardly from said hinge panel in a plane offset upwardly from the plane of said bottom filter batt member and a stressed position extending upwardly from said hinge panel, the border frame for said front filter batt member having integral forward and rearwardly angled tabs providing latch members engageable with the outer and inner portions respectively, of the free edge of said front opening when said front filter batt is in said stressed position, said front filter batt member being movable in accordance with the flexibility of said hinge panel to effect the engagement of said tabs with said free edge, whereby said front filter batt member is maintained by its stressed position in closed and covering relation with said front access opening when said air filtering means is in said machinery compartment, and whereby downwardly pressure on said front filter batt member effects a slight flexing of said hinge panel to release said tabs from said free edge so said front filter batt member may return to its normal position for removal of said air filtering means from said machinery compartment.

* * * * *